US009349269B2

(12) United States Patent
Zhevelev et al.

(10) Patent No.: US 9,349,269 B2
(45) Date of Patent: May 24, 2016

(54) GLASS BREAKAGE DETECTION SYSTEM AND METHOD OF CONFIGURATION THEREOF

(71) Applicant: Tyco Fire & Security GmbH, Neuhausen am Rheinfall (CH)

(72) Inventors: Boris Zhevelev, Rishon-le-Zion (IL); Michael Lahat, Kiryat Ono (IL)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 101 days.

(21) Appl. No.: 14/147,645

(22) Filed: Jan. 6, 2014

(65) Prior Publication Data

US 2015/0194036 A1 Jul. 9, 2015

(51) Int. Cl.

| | |
|---|---|
| ***G08B 13/04*** | (2006.01) |
| ***G08B 21/18*** | (2006.01) |
| ***H04R 29/00*** | (2006.01) |
| ***G08B 13/16*** | (2006.01) |
| ***G08B 29/22*** | (2006.01) |

(52) U.S. Cl.

CPC ..... *G08B 21/18* (2013.01); *G08B 13/04* (2013.01); *G08B 13/1672* (2013.01); *G08B 29/22* (2013.01); *H04R 29/00* (2013.01)

(58) Field of Classification Search

CPC .... G08B 13/04; G08B 13/1672; G08B 21/18; G12B 13/00; G01H 3/08

USPC ..... 340/540, 541, 550, 566; 367/13, 93; 381/82, 92

See application file for complete search history.

(56) References Cited

U.S. PATENT DOCUMENTS

| | | | | |
|---|---|---|---|---|
| 4,668,941 | A | 5/1987 | Davenport et al. | |
| 4,853,677 | A | 8/1989 | Yarbrough et al. | |
| 5,192,931 | A | 3/1993 | Smith et al. | |
| 5,323,141 | A | 6/1994 | Petek | |
| 5,341,122 | A | 8/1994 | Rickman | |
| 5,471,195 | A * | 11/1995 | Rickman | G08B 13/04 340/546 |

(Continued)

FOREIGN PATENT DOCUMENTS

| | | |
|---|---|---|
| EP | 0215685 A2 | 3/1987 |
| EP | 2023305 B1 | 4/2011 |

(Continued)

OTHER PUBLICATIONS

An International Search Report and a Written Opinion both dated Apr. 30, 2015, which issued during the prosecution of Applicant's PCT/IL2014/051125.

*Primary Examiner* — Hung T Nguyen

(74) *Attorney, Agent, or Firm* — HoustonHogle, LLP

(57) ABSTRACT

A glass breakage detector system including an audio sensor, room-specific evaluation function generating functionality operative to generate at least one room-specific audio signal alarm evaluation function based on at least one of at least one acoustic parameter characterizing a room in which the audio sensor is located and at least two of the following environmental parameters: a size of the room, at least one size of at least one glass element in the room, at least one type of the at least one glass element in the room and at least one distance between the at least one glass element and the audio sensor, and alarm generation functionality operative to receive outputs from the audio sensor and to generate a glass breakage alarm when the outputs from the audio sensor fulfill criteria established by the at least one room-specific audio signal alarm evaluation function.

22 Claims, 6 Drawing Sheets

(56) References Cited

U.S. PATENT DOCUMENTS

| | | | | |
|---|---|---|---|---|
| 5,510,767 | A | 4/1996 | Smith | |
| 5,515,029 | A | 5/1996 | Zhevelev et al. | |
| 5,524,099 | A | 6/1996 | Rickman et al. | |
| 5,552,770 | A | 9/1996 | McMaster | |
| 5,640,142 | A | 6/1997 | Matatall, Jr. et al. | |
| 5,640,143 | A | 6/1997 | Myron et al. | |
| 5,675,320 | A | 10/1997 | Cecic et al. | |
| 5,796,336 | A | 8/1998 | Ishino et al. | |
| 5,831,528 | A | 11/1998 | Cecic et al. | |
| 5,917,410 | A | 6/1999 | Cecic et al. | |
| 6,111,957 | A | 8/2000 | Thomasson | |
| 6,236,313 | B1 * | 5/2001 | Eskildsen et al. | 340/550 |
| 6,351,214 | B2 * | 2/2002 | Eskildsen et al. | 340/550 |
| 6,493,687 | B1 | 12/2002 | Wu et al. | |
| 7,302,073 | B2 | 11/2007 | Smith et al. | |
| 7,443,289 | B2 | 10/2008 | Smith | |
| 7,680,283 | B2 | 3/2010 | Eskildsen | |
| 7,812,855 | B2 * | 10/2010 | Babich et al. | 348/143 |
| 8,036,063 | B2 | 10/2011 | Smith et al. | |
| 8,199,608 | B2 | 6/2012 | Piel et al. | |
| 2001/0033227 | A1 | 10/2001 | Eskildsen et al. | |
| 2005/0264413 | A1 * | 12/2005 | Eskildsen | 340/522 |
| 2007/0008125 | A1 * | 1/2007 | Smith | B60R 25/1009 340/566 |
| 2007/0024443 | A1 * | 2/2007 | Babich et al. | 340/545.2 |
| 2008/0310254 | A1 * | 12/2008 | Piel et al. | 367/13 |
| 2009/0040869 | A1 | 2/2009 | Smith et al. | |
| 2009/0073803 | A1 * | 3/2009 | Smith | 367/13 |
| 2013/0076506 | A1 | 3/2013 | Smith et al. | |
| 2013/0170323 | A1 * | 7/2013 | Smith | 367/197 |

FOREIGN PATENT DOCUMENTS

| | | |
|---|---|---|
| EP | 2 605 223 | 6/2013 |
| WO | 00/02420 A1 | 1/2000 |

* cited by examiner

MS
T (SEC)
L1
L2
L3
L4

FMS1
T (SEC)

FMS2
T (SEC)

ES
T (SEC)
T1
T2
T3
T4
T5
L1
L2
L3
L4

D (ES)/DT
T (SEC)

GLASS BREAKAGE DETECTION SYSTEM AND METHOD OF CONFIGURATION THEREOF

FIELD OF THE INVENTION

The present invention relates to glass breakage detectors generally.

BACKGROUND OF THE INVENTION

Various types of glass breakage detectors are known in the art. One major shortcoming of currently available glass breakage detectors is that they are typically installed and configured with parameters which typically do not include parameters specific to the installation site, such as, for example, specific acoustic conditions of the installation site.

SUMMARY OF THE INVENTION

The present invention seeks to provide an improved glass breakage detector system.

There is thus provided in accordance with a preferred embodiment of the present invention a glass breakage detection system including:

an audio sensor;

room-specific evaluation function generating functionality operative to generate at least one room-specific audio signal alarm evaluation function based on at least one of at least one acoustic parameter characterizing a room in which the audio sensor is located and at least two of the following environmental parameters:

a size of the room in which the audio sensor is located;

at least one size of at least one glass element in the room in which the audio sensor is located;

at least one type of the at least one glass element in the room in which the audio sensor is located; and at least one distance between the at least one glass element and the audio sensor; and alarm generation functionality operative to receive outputs from the audio sensor and to generate a glass breakage alarm when the outputs from the audio sensor fulfill criteria established by the at least one room-specific audio signal alarm evaluation function.

Preferably, the glass breakage detection system also includes acoustic parameter generating functionality operative to generate the at least one acoustic parameter characterizing the room in which the audio sensor is located.

Preferably, the glass breakage detection system also includes sound receiving functionality operative to receive received sounds in the room, the received sounds resulting from emitted sounds having traveled through the room, the acoustic parameter generating functionality being operative to generate the at least one acoustic parameter characterizing the room in which the audio sensor is located responsive to analysis of the emitted sounds and the received sounds.

Preferably, the glass breakage detection system also includes sound generating functionality operative to automatically generate the emitted sounds in the room. Additionally or alternatively, the emitted sounds are generated manually in the room by an operator of the glass breakage detection system.

Preferably, the analysis of the sounds includes analysis of at least one of the extent of the presence of acoustic reflections in the room, the extent of the presence of acoustic resonance in the room, and the amplitude modulation as a function of frequency occurring as sound passes from the at least one glass element to the audio sensor in the room.

Preferably, at least one of the environmental parameters is automatically obtained by a camera. Additionally or alternatively, at least one of the environmental parameters is calculated manually.

Preferably, the at least one room-specific audio signal alarm evaluation function generated by the room-specific evaluation function generating functionality is transmitted to the alarm generation functionality by at least one of optic, acoustic and electronic transmission.

There is also provided in accordance with another preferred embodiment of the present invention a method for installing and operating a glass breakage detection system, the method including generating at least one room-specific audio signal alarm evaluation function based on at least one of at least one acoustic parameter characterizing a room in which an audio sensor is located and at least two of the following environmental parameters:

a size of the room in which the audio sensor is located;

at least one size of at least one glass element in the room in which the audio sensor is located;

at least one type of the at least one glass element in the room in which the audio sensor is located; and at least one distance between the at least one glass element and the audio sensor; and receiving outputs from the audio sensor and generating a glass breakage alarm when the outputs from the audio sensor fulfill criteria established by the at least one room-specific audio signal alarm evaluation function.

Preferably, the method also includes generating the at least one acoustic parameter characterizing the room in which the audio sensor is located. Preferably, generating the at least one acoustic parameter characterizing the room in which the audio sensor is located includes generating emitted sounds in the room, receiving received sounds in the room, the received sounds resulting from the emitted sounds after traveling through the room, and analyzing the emitted sounds and the received sounds.

Preferably, generating emitted sounds in the room is performed manually. Additionally or alternatively, generating emitted sounds in the room is performed automatically.

Preferably, analyzing the emitted sounds and the received sounds includes analyzing at least one of the extent of the presence of acoustic reflections in the room, the extent of the presence of acoustic resonance in the room, and the amplitude modulation as a function of frequency occurring as sound passes from the at least one glass element to the audio sensor in the room.

Preferably, at least one of the environmental parameters is automatically obtained by a camera. Additionally or alternatively, at least one of the environmental parameters is calculated manually.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
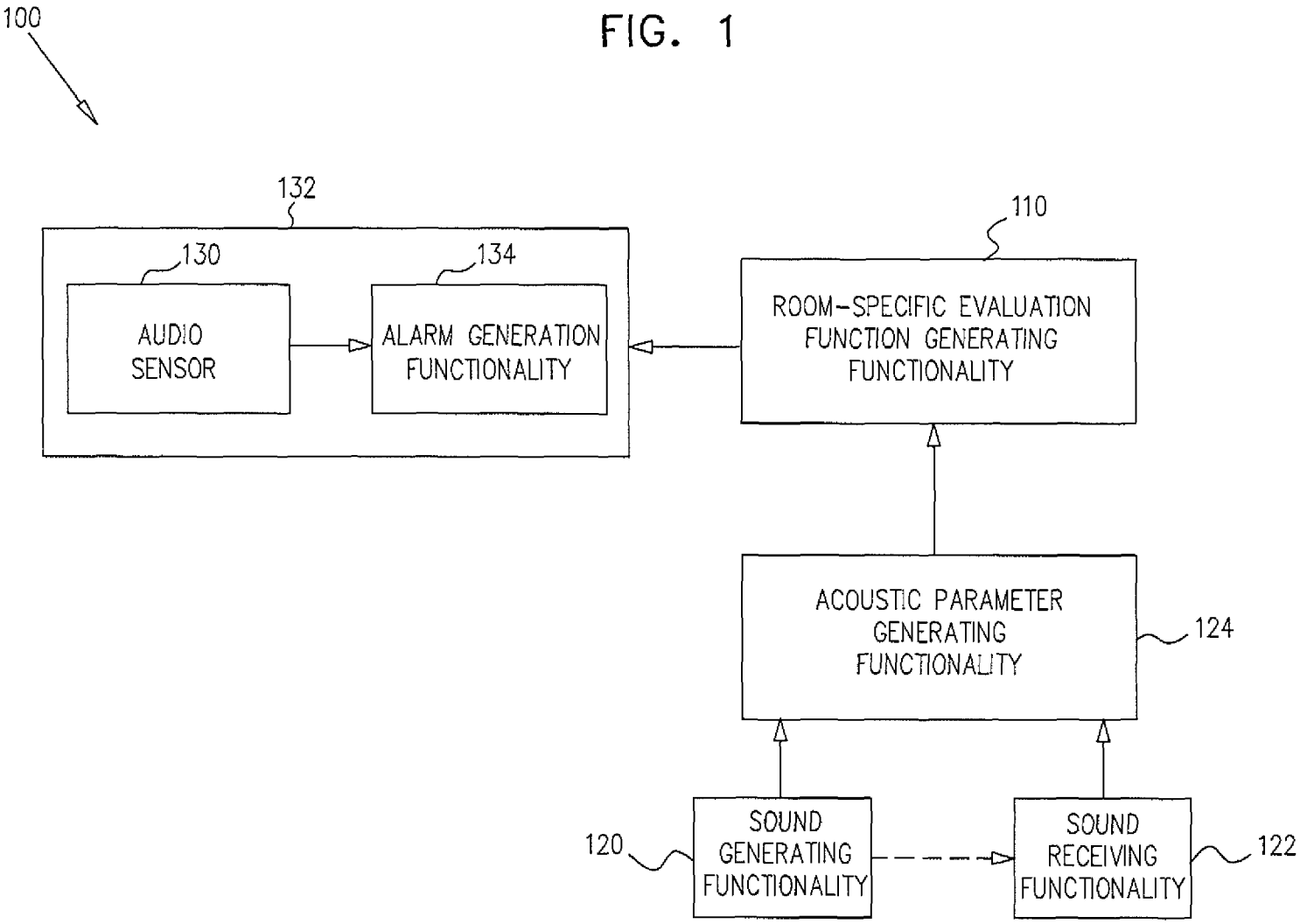
FIG. 1 is a simplified block diagram illustration of a glass breakage detection system constructed and operative in accordance with a preferred embodiment of the present invention in a typical room.

Reference is now made to FIG. 1, which is a simplified block diagram illustration of a glass breakage detection system 100 constructed and operative in accordance with a preferred embodiment of the present invention in a typical room. The glass breakage detection system of the present invention is operative to differentiate between detection of actual breakage of glass, such as a window pane of a window in a residence, which may be indicative of an intrusion into the residence, and other similar noises which are typically not indicative of an intrusion into the residence.

As seen in FIG. 1, the glass breakage detection system includes room-specific evaluation function generating functionality 110 operative to generate at least one room-specific audio signal alarm evaluation function based on at least one of:

at least one acoustic parameter characterizing said room in which said audio sensor is located; and at least two of the following environmental parameters:

a size of a room in which the audio sensor is located;

at least one size of at least one glass element in the room in which the audio sensor is located;

at least one type of the at least one glass element in the room in which the audio sensor is located; and at least one distance between the at least one glass element and the audio sensor.

Glass breakage detection system 100 also preferably includes sound generating functionality 120 operative to generate emitted sounds in the room, and sound receiving functionality 122 operative to receive received sounds in the room, the received sounds resulting from the emitted sounds after traveling through the room. Acoustic parameter generating functionality 124 is preferably provided for analyzing the emitted sounds and the received sounds and, responsive thereto, for generating at least one acoustic parameter characterizing the room in which the audio sensor is located.

Analyzing the emitted sounds and the received sounds by acoustic parameter generating functionality 124 preferably includes analysis of at least one of:

the extent of the presence of acoustic reflections in the room;

the extent of the presence of acoustic resonance in the room; and the amplitude modulation as a function of frequency occurring as sound passes from the at least one glass element to the audio sensor in the room.

As further seen in FIG. 1, a preferred embodiment of the glass breakage detection system 100 includes an audio sensor 130 located within a typical room having multiple windows, and preferably, but not necessarily, enclosed in a single housing 132 with the audio sensor 130 there is provided alarm generation functionality 134 operative to operative to receive outputs from audio sensor 130 and to generate a glass breakage alarm when the outputs from audio sensor 130 fulfill criteria established by a room-specific audio signal alarm evaluation function generated by room-specific evaluation function generating functionality 110.

It is appreciated that room-specific audio signal alarm evaluation functions generated by room-specific evaluation function generating functionality 110 are transmitted to alarm generation functionality 134. The transmission may be, for example, optic, acoustic or electronic.

Figure 2A:
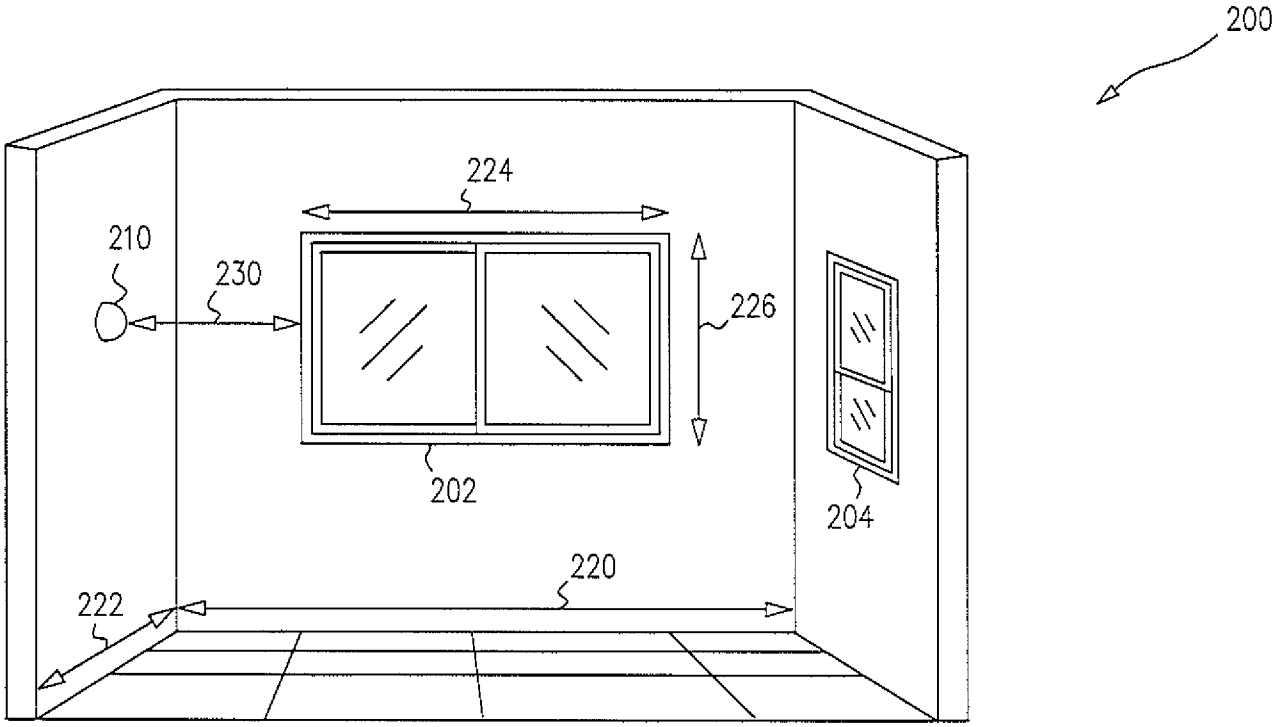
FIG. 2A is a simplified pictorial illustration of the environmental parameters of a typical room, which are employed by the system of FIG. 1.

Reference is now made to FIG. 2A, which is a simplified pictorial illustration of the environmental parameters of a typical room, which are employed by room-specific evaluation function generating functionality 110 of system 100 of FIG. 1.

As shown in FIG. 2A, room 200 has two glass pane windows 202 and 204. A glass breakage detector 210, such as audio sensor 130 of FIG. 1, is preferably installed on a wall generally opposite windows 202 and 204.

As described hereinabove with reference to FIG. 1, the following environmental parameters of room 200 are preferably employed by room-specific evaluation function generating functionality 110:

a size of room 200, as calculated using a length 220 and a width 222 of room 200;

a size of window 202, as calculated using a length 224 and a height 226 of window 202;

the glass type of window 202; and a distance 230 between window 202 and glass breakage detector 210.

Figure 2B:
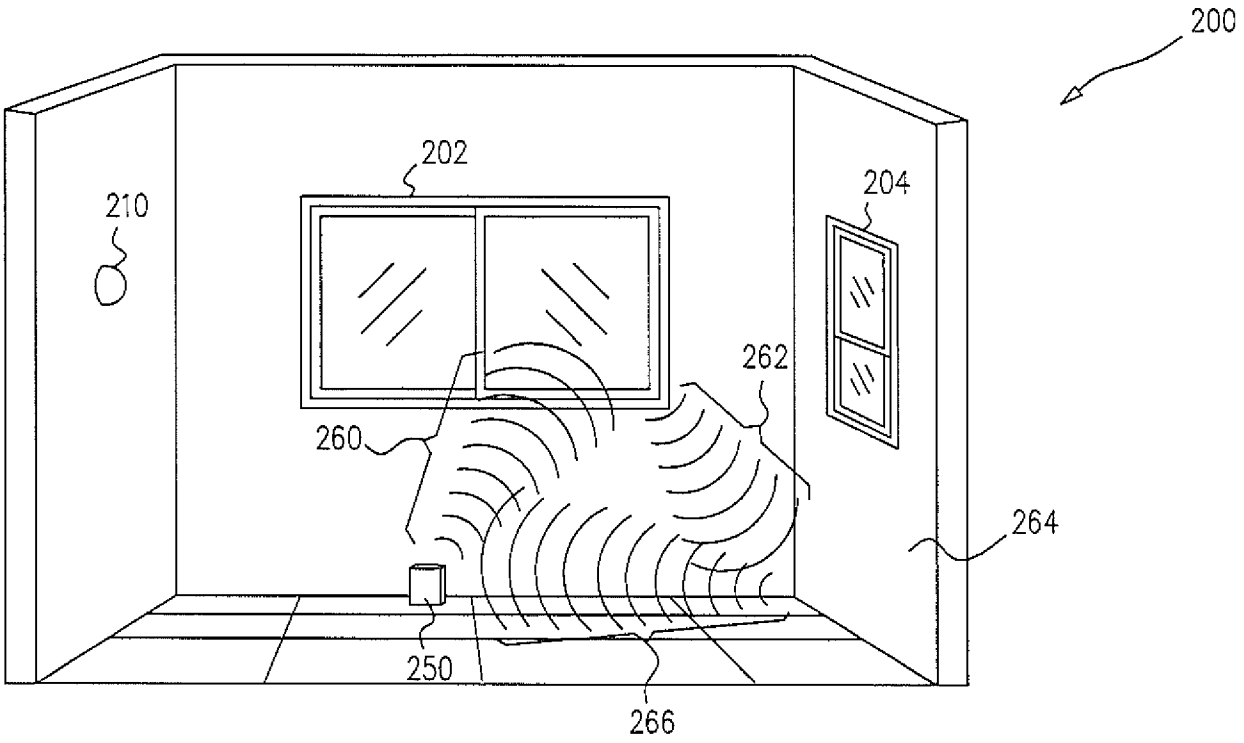
FIGS. 2B and 2C are simplified pictorial illustration of examples of operation of the acoustic parameter generating functionality of the system of FIG. 1.
Figure 2C:
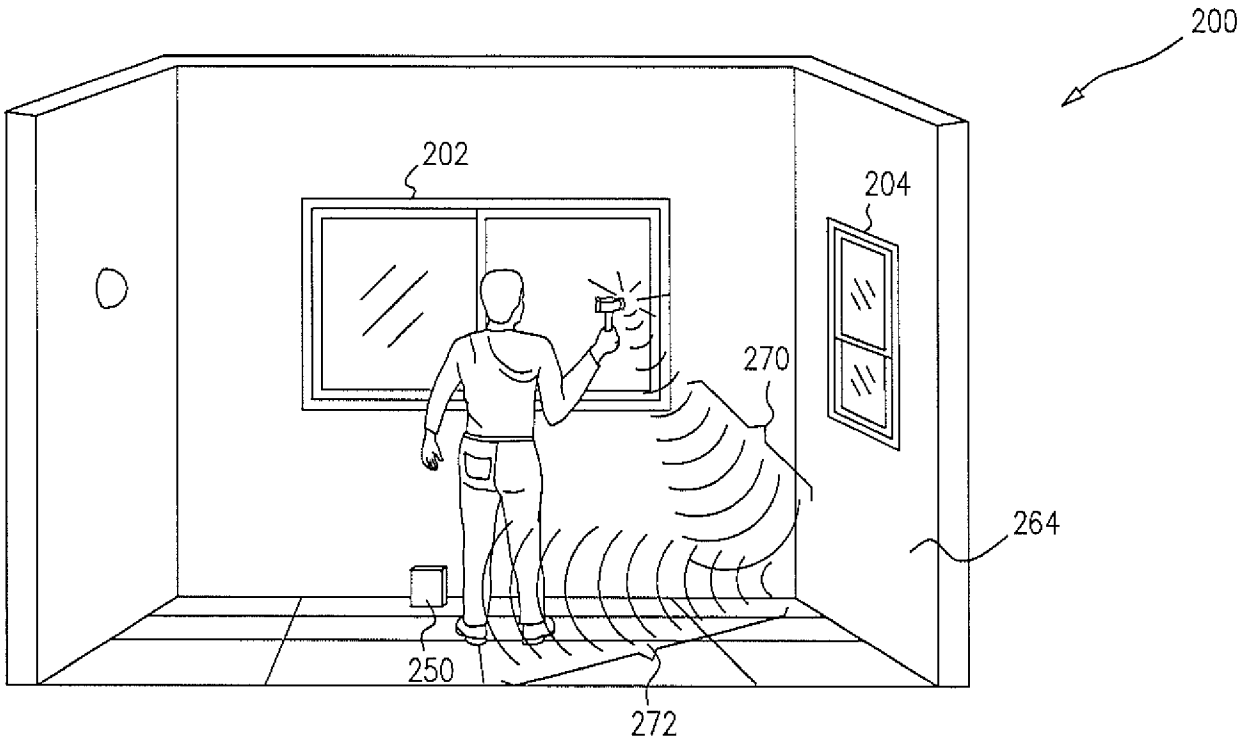

Reference is now made to FIGS. 2B and 2C, which are simplified pictorial illustration of examples of operation of the acoustic parameter generating functionality of the system of FIG. 1.

As shown in FIG. 2B, an acoustic parameter generating device 250 is preferably placed within room 200 in an installation phase of glass breakage detector 210. Acoustic parameter generating device 250 preferably includes sound generating functionality, sound receiving functionality and acoustic parameter generating functionality such as sound generating functionality 120, sound receiving functionality 122 and acoustic parameter generating functionality 124 described hereinabove with reference to FIG. 1.

As further shown in FIG. 2B, in the installation phase of glass breakage detector 210, acoustic parameter generating device 250 emits a sound wave 260 which impinges on window 202. Sound wave 260 is then reflected from window 202 in the form of sound wave 262 which impinges on wall 264 of room 200. Sound wave 262 is then reflected from wall 264 in the form of sound wave 266 which is finally received by device 250.

It is a particular feature of the present invention that acoustic parameter generating device 250 is operative to analyze emitted sound wave 260 and a corresponding echo in the form of received sound wave 266 and, responsive thereto, to generate at least one acoustic parameter characterizing room 200, which acoustic parameter is employed in generating a room-specific evaluation function used by alarm generation functionality to ascertain whether an alarm should be sounded in response to a sound detected by glass breakage detector 210.

It is appreciated that acoustic parameter generating device 250 may be employed to generate a multiplicity of acoustic parameters during an installation phase of glass breakage detector 210, by analyzing a corresponding multiplicity of alternative sound waves emitted in varying directions and a respective multiplicity of echoes.

Turning now to FIG. 2C, it is shown that acoustic parameter generating device 250 may be operated in conjunction with manual generation of a sound wave 270, such as by tapping on window. Sound wave 270 then impinges on wall 264 of room 200, and is then reflected from wall 264 in the form of sound wave 272 which is received by device 250.

Figure 3:
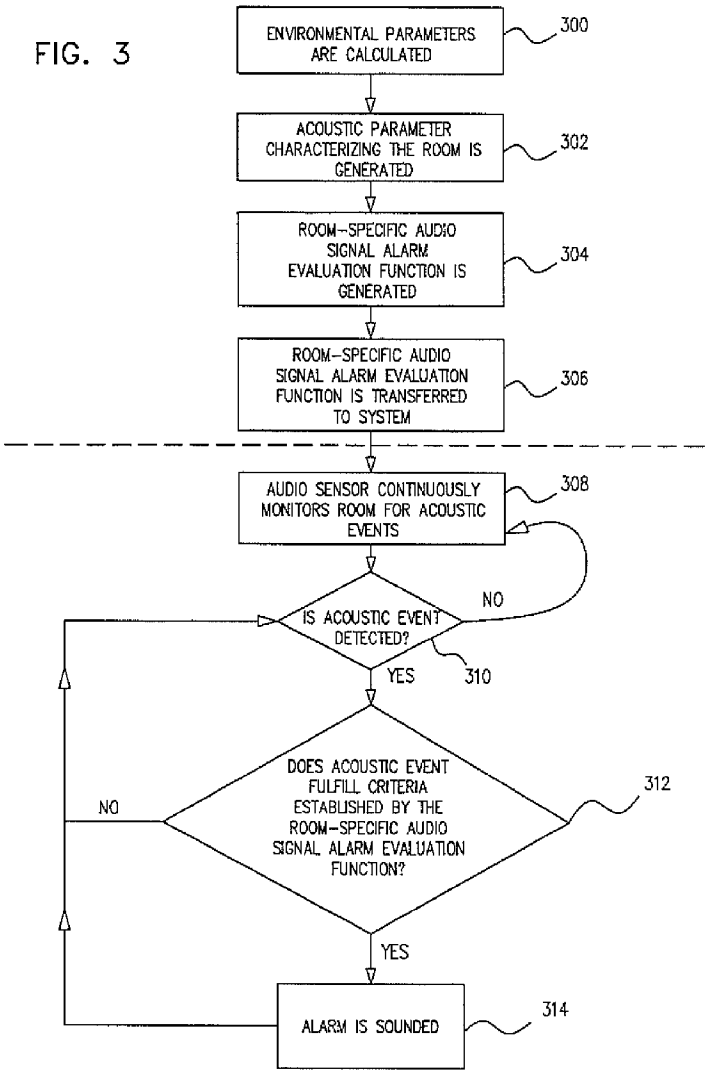
FIG. 3 is a simplified flowchart of the operation of the glass breakage detection system of FIG. 1.

Reference is now made to FIG. 3, which is a simplified flowchart of the operation of the glass breakage detection system of FIG. 1.

As shown in FIG. 3, in an installation phase of the glass breakage detection system having an audio sensor, environmental parameters relating to the environment in which the glass breakage detection system is deployed are initially calculated (300). It is appreciated that the environmental parameters may be calculated manually by an operator of the system or may be calculated automatically by a automated mechanism associated with the system, such as, for example, a camera or an electronic measuring device.

As described hereinabove with reference to FIG. 1, the environmental parameters preferably include:

a size of a room in which the audio sensor is located;

at least one size of at least one glass element in the room in which the audio sensor is located;

at least one type of the at least one glass element in the room in which the audio sensor is located; and at least one distance between the at least one glass element and the audio sensor.

Subsequently, as further shown in FIG. 3, at least one acoustic parameter characterizing the room is generated (302). As described hereinabove, the acoustic parameter characterizing the room is generated is generated by analyzing of at least one of:

the extent of the presence of acoustic reflections in the room;

the extent of the presence of acoustic resonance in the room; and the amplitude modulation as a function of frequency occurring as sound passes from the at least one glass element to the audio sensor in the room.

Thereafter, room-specific evaluation function generating functionality is preferably employed to generate a room-specific audio signal alarm evaluation function (304). As described hereinabove, the room-specific audio signal alarm evaluation function is based on at least one of the acoustic parameter and at least two environmental parameters. Concluding the installation phase, the room-specific audio signal alarm evaluation function is then preferably transferred to the system (306). It is appreciated that the steps of the installation phase may be repeated, for example, for each glass element in the room.

Thereafter, in an operational phase, the audio sensor continuously monitors the room for acoustic events (308). Upon detecting an acoustic event in the room (310), the room-specific audio signal alarm evaluation function is preferably employed by alarm generation functionality of the system to ascertain whether the acoustic event detected by the audio sensor fulfill criteria established by the room-specific audio signal alarm evaluation function (312). Upon ascertaining that the event detected by the audio sensor fulfills criteria established by the room-specific audio signal alarm evaluation function, an alarm is sounded (314).

Reference is now made to FIGS. 4A, 4B, 4C, 4D and 4E, which are simplified illustrations of an example of electrical signals generated from outputs of an audio sensor which is part of the glass breakage detection system of FIG. 1. The electrical signals of FIGS. 4A-4E are instrumental in describing the following example of employing a room-specific audio signal alarm evaluation function generated by the method described hereinabove with reference to FIGS. 1-3 to ascertain whether to generate a glass breakage alarm in response to outputs received from an audio sensor.

In the example of FIGS. 4A-4E, the room-specific audio signal alarm evaluation function (EF) is as follows:

$$EF=(f_f*k_1+f_2*k_2+f_3*k_3+\ldots+f_n*k_n)*C_1*C_2*C_3\ldots*C_n,\text{ wherein:}$$

$f_1, f_2, f_3, \ldots f_n$ are functions corresponding to electrical signals generated by electronic detection of an acoustic event of glass breakage;

$k_1, k_2, k_3, \ldots k$ are coefficients $[0 \le k \le 1]$ which have preferably been statistically or empirically proven to provide a correct weight of each of the electrical signals; and $C_1, C_2, C_3 \ldots C_n$ are factors associated with environmental parameters and acoustic parameters of the room in which the audio sensor is located.

Figures 4A, 4B, 4C, 4D, 4E:
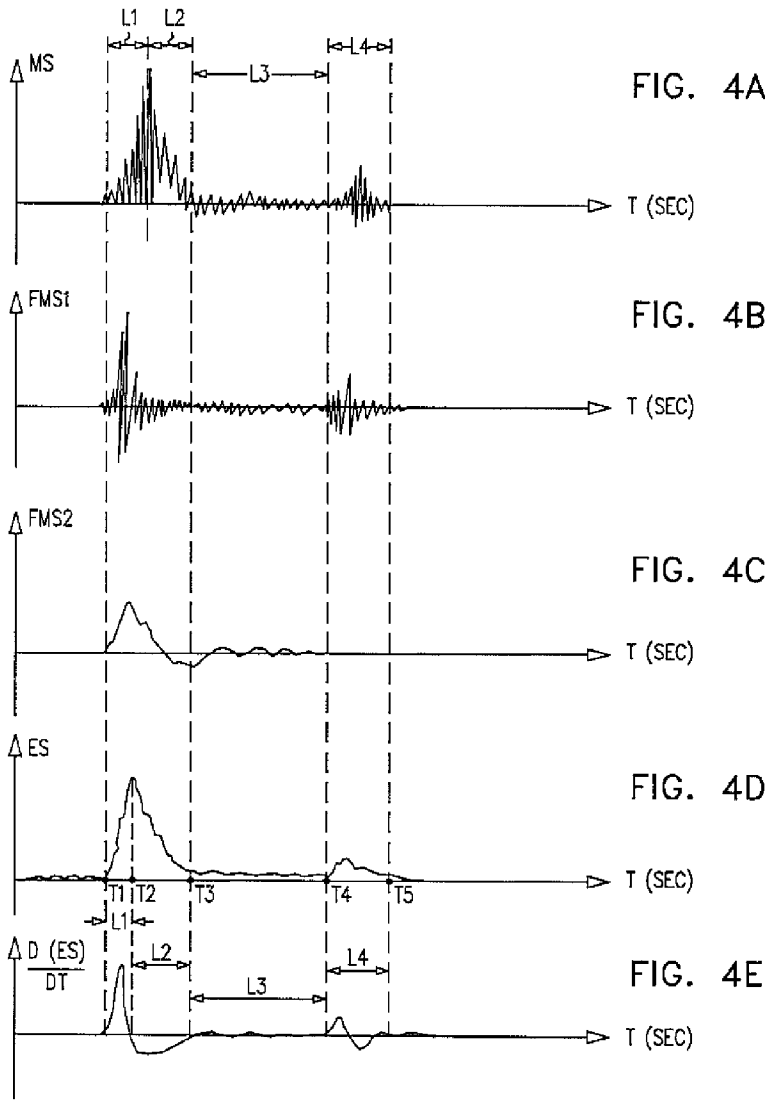
FIGS. 4A, 4B, 4C, 4D and 4E are simplified illustrations of an example of electrical signals generated from outputs of an audio sensor which is part of the glass breakage detection system of FIG. 1.

As shown in FIG. 4A, a microphone signal (MS), which corresponds to a signal typically generated by glass breakage is received from the audio sensor. As shown in FIG. 4A, the signal comprises an initial relatively high burst of energy (L1) and a relatively slow signal decreasing (L2), and after time (L3) a relatively weak signal indicating falling debris (L4). It is appreciated that breakage of laminated or tempered glass will typically not generate sounds corresponding to falling debris.

As shown in FIG. 4B, the microphone signal (MS) is filtered to obtain a filtered microphone signal (FMS1) having a frequency band of 2-5 KHz. The filtered microphone signal corresponds to the audible frequencies of the glass breakage after filtering out a flex wave corresponding to an inaudible air pressure wave generated by the deformation of the breaking glass surface.

As shown in FIG. 4C, a second filtered microphone signal (FMS2) with frequency band of 5-20 Hz is calculated. The second filtered microphone signal corresponds to the flex wave corresponding to an inaudible air pressure wave generated by the deformation of the breaking glass surface.

FIG. 4D illustrates a normalized signal (ES), which corresponds to an envelope line of the FMS1 signal of FIG. 4B. Random noise is smoothed out and the envelope characteristic is normalized by its maximum value.

FIG. 4E illustrates a derivative signal [d(ES)/dt], which is derived from the ES signal of FIG. 4D.

In the example of FIGS. 4A-4E, the room-specific audio signal alarm evaluation function (EF) is based on the normalized signal (ES) as follows:

$$f_1=P2/P1,\text{ wherein:}$$

P1 is an area below the signal line of ES (FIG. 4D) from an initial point in time ($t_1$) to a point in time ($t_2$) for which ES reaches its maximal value; and P2 is and area below the signal line of ES (FIG. 4D) from $t_2$ to an end point in time ($t_3$).

$$f_2=S2/S1,\text{ wherein:}$$

S1 is a calculated maximum value of the derivative [d(ES)/dt] (FIG. 4E) between time points [$t_1$, $t_2$]; and S2 is a calculated maximum value of derivative [d(ES)/dt] between time points [$t_2$, $t_3$].

$f_3$=P3/(P1+P2), wherein P1 and P2 are described hereinabove and wherein P3 is an area below the signal line of ES between time points [$t_4$, $t_5$], which are defined as points in time of the signal line ES corresponding to L4 described hereinabove.

Scaling factors $C_1, C_2, C_3 \ldots C_n$ can be estimated or calculated values. Calculations can be performed based on measured installation parameters. For example, $C_1$ may correspond to an echo factor of the room, as follows:

$$C_1=[(T\max-Tc)/T\max]*M1+0.1$$

wherein:

Tc is the measured time interval between time points $[t_1, t_5]$;

Tmax is a statistical maximum time interval between time points $[t_1, t_5]$; and M1 is an empirical scaling coefficient.

$C_2$ may correspond to a size of the glass window in the room. For example:

$C_2$=1.0 for glass size between 30×30 cm and 50×50 cm;

$C_2$=0.5 for glass area between 50×50 cm and 100×100 cm; and $C_2$=0.25 for glass area between 100×100 cm and 150×150 cm.

$C_3$ may correspond to a distance between the glass window and the audio sensor, as follows:

$$C_3=[1-(D\max-Dc)/D\max]*M3+0.1$$

wherein:

Dc is an estimated or measured distance between the glass window and the audio sensor;

Dmax is the maximum allowed distance between the glass window and the audio sensor; and M3 is an empirical scaling coefficient.

$C_4$ may correspond to a glass type. For example, this factor may vary between several discrete values as following:

$C_4$=1.0 for laminated glass;

$C_4$=0.5 for wired glass; and $C_4$=0.25 for plate or tempered glass.

$C_5$ may correspond to a flex wave factor, which reflects the direction of the flex wave. The flex wave generated by the breakage of a glass pane may be positive (outside to inside) in which case an alarm should be sounded, or negative (inside to outside) in which case an alarm should not be sounded. Accordingly, $C_5$ may have one of two values:

$C_5$=1 under the condition that initially FMS2 (FIG. 4C) is positive; and $C_5$=0 under the condition that initially FMS2 (FIG. 4C) is negative.

It will be appreciated by persons skilled in the art that the present invention is not limited by what has been particularly shown and described hereinabove. Rather the scope of the present invention includes both combinations and subcombinations of the various features described hereinabove as well as modifications thereof which would occur to persons skilled in the art upon reading the foregoing description and which are not in the prior art.

The invention claimed is:

1. A glass breakage detection system comprising:

room-specific evaluation function generating functionality operative, in an installation phase, to automatically generate at least one room-specific audio signal alarm evaluation function based on at least one generated acoustic parameter characterizing a room, said generated acoustic parameter characterizing said room being based on analysis of an extent of the presence of acoustic resonance in said room; and alarm generation functionality operative, in an operational phase following said installation phase, to receive outputs from a glass breakage detector located in said room and to generate a glass breakage alarm when said outputs from said glass breakage detector fulfill criteria established by said at least one room-specific audio signal alarm evaluation function.

2. A glass breakage detection system according to claim 1 and also comprising acoustic parameter generating functionality operative to generate said at least one acoustic parameter characterizing said room in which said glass breakage detector is located.

3. A glass breakage detection system according to claim 2 and also comprising:

sound receiving functionality operative to receive received sounds in said room, said received sounds resulting from emitted sounds having traveled through said room;

said acoustic parameter generating functionality being operative to generate said at least one acoustic parameter characterizing said room in which said glass breakage detector is located responsive to analysis of said emitted sounds and said received sounds.

4. A glass breakage detection system according to claim 3 and also comprising:

sound generating functionality operative to automatically generate said emitted sounds in said room.

5. A glass breakage detection system according to claim 3 and wherein said emitted sounds are generated manually in said room by an operator of said glass breakage detection system.

6. A glass breakage detection system according to claim 3 and wherein said analysis of said sounds comprises analysis of at least one of:

an extent of the presence of acoustic reflections in said room;

an extent of the presence of acoustic resonance in said room; and an amplitude modulation as a function of frequency occurring as sound passes from said at least one glass element to said glass breakage detector in said room.

7. A glass breakage detection system according to claim 1 and wherein said at least one room-specific audio signal alarm evaluation function generated by said room-specific evaluation function generating functionality is transmitted to said alarm generation functionality by at least one of optic, acoustic and electronic transmission.

8. A glass breakage detection system according to claim 1 and wherein said at least one room-specific audio signal alarm evaluation function is also based on at least two of the following environmental parameters:

a size of said room in which said glass breakage detector is located;

at least one size of at least one glass element in said room in which said glass breakage detector is located;

at least one type of said at least one glass element in said room in which said glass breakage detector is located; and at least one distance between said at least one glass element and said glass breakage detector.

9. A glass breakage detection system according to claim 8 and wherein at least one of said environmental parameters is automatically obtained by a camera.

10. A glass breakage detection system according to claim 8 and wherein at least one of said environmental parameters is calculated manually.

11. A glass breakage detection system according to claim 1 and wherein said glass breakage detector is an audio sensor.

12. A method for installing and operating a glass breakage detection system according to claim 11 and wherein at least one of said environmental parameters is automatically obtained by a camera.

13. A method for installing and operating a glass breakage detection system according to claim 11 and wherein at least one of said environmental parameters is calculated manually.

14. A glass breakage detection system according to claim 1 and also comprising said glass breakage detector.

15. A method for installing and operating a glass breakage detection system, said method comprising:

in an installation phase, automatically generating at least one room-specific audio signal alarm evaluation function based on at least one generated acoustic parameter characterizing a room, said generated acoustic parameter characterizing said room being based on analysis of:

an extent of the presence of acoustic resonance in said room; and in an operational phase following said installation phase, receiving outputs from a glass breakage detector located in said room and generating a glass breakage alarm when said outputs from said glass breakage detector fulfill criteria established by said at least one room-specific audio signal alarm evaluation function.

16. A method for installing and operating a glass breakage detection system according to claim 15 and also comprising generating said at least one acoustic parameter characterizing said room in which said glass breakage detector is located.

17. A method for installing and operating a glass breakage detection system according to claim 16 and wherein generating said at least one acoustic parameter characterizing said room in which said glass breakage detector is located comprises:

generating emitted sounds in said room;

receiving received sounds in said room, said received sounds resulting from said emitted sounds after traveling through said room; and analyzing said emitted sounds and said received sounds.

18. A method for installing and operating a glass breakage detection system according to claim 17 and wherein said generating emitted sounds in said room is performed manually.

19. A method for installing and operating a glass breakage detection system according to claim 17 and wherein said generating emitted sounds in said room is performed automatically.

20. A method for installing and operating a glass breakage detection system according to claim 17 and wherein said analyzing said emitted sounds and said received sounds comprises analyzing at least one of:

an extent of the presence of acoustic reflections in said room;

an extent of the presence of acoustic resonance in said room; and an amplitude modulation as a function of frequency occurring as sound passes from said at least one glass element to said glass breakage detector in said room.

21. A method for installing and operating a glass breakage detection system according to claim 15 and wherein said at least one room-specific audio signal alarm evaluation function is also based on at least two of the following environmental parameters:

a size of said room in which said glass breakage detector is located;

at least one size of at least one glass element in said room in which said glass breakage detector is located;

at least one type of said at least one glass element in said room in which said glass breakage detector is located; and at least one distance between said at least one glass element and said glass breakage detector.

22. A glass breakage detection system according to claim 15 and wherein said glass breakage detector is an audio sensor.

* * * * *